United States Patent [19]

Hirai et al.

[11] Patent Number: 4,473,631

[45] Date of Patent: Sep. 25, 1984

[54] HEAT-DEVELOPABLE COLOR PHOTOGRAPHIC MATERIAL

[75] Inventors: Hiroyuki Hirai; Hideki Naito; Hiroshi Hara; Kozo Sato, all of Kanagawa, Japan

[73] Assignee: Fuji Photo Film Co., Ltd., Kanagawa, Japan

[21] Appl. No.: 548,818

[22] Filed: Nov. 4, 1983

[30] Foreign Application Priority Data

Nov. 5, 1982 [JP] Japan ..... 57-194202

[51] Int. Cl.[3] ..... G03C 5/54; G03C 1/40; G03C 1/10

[52] U.S. Cl. ..... 430/203; 430/216; 430/218; 430/223; 430/351; 430/372; 430/559; 430/562; 430/617; 430/619

[58] Field of Search ..... 430/203, 216, 218, 219, 430/223, 351, 372, 617, 619, 559, 551, 607, 611, 955

[56] References Cited

U.S. PATENT DOCUMENTS

| | | | |
|---|---|---|---|
| 4,411,984 | 10/1983 | Gabrielsen | 430/351 |
| 4,430,415 | 2/1984 | Aono et al. | 430/203 |
| 4,439,513 | 3/1984 | Sato et al. | 430/203 |

FOREIGN PATENT DOCUMENTS

| | | | |
|---|---|---|---|
| 0066282 | 2/1982 | European Pat. Off. | 430/203 |

*Primary Examiner*—Richard L. Schilling

*Attorney, Agent, or Firm*—Sughrue, Mion, Zinn, Macpeak & Seas

[57] ABSTRACT

A heat-developable color photographic material is disclosed. The material is comprised of a support having thereon at least a light-sensitive silver halide, a hydrophilic binder, a dye releasing compound reductive and capable of releasing a hydrophilic dye and a compound represented by the following general formula (A):

(A)

wherein $A_1$, $A_2$, $A_3$, and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group, or $A_1$ and $A_2$ or $A_3$ and $A_4$ may combine with each other to form a ring.

The heat-developable color photographic material can easily provide in a short time a clear and stable color image having a high color density and low fog by imagewise exposure and heat development procedure. A method of forming a color image using the heat-developable color photographic material is also disclosed.

22 Claims, No Drawings

HEAT-DEVELOPABLE COLOR PHOTOGRAPHIC MATERIAL

FIELD OF THE INVENTION

The present invention relates to a photographic material for forming a color image by heat development. Particularly, the present invention relates to a novel process for obtaining a color image by heat diffusion transfer of a dye released upon heat development of a heat-developable color photographic material containing a dye releasing compound which releases a diffusible dye upon heat-development into a support capable of receiving a dye.

BACKGROUND OF THE INVENTION

Photographic processes using silver halide have been most widely used in the past due to their excellent photographic properties such as sensitivity or control of gradation, etc., as compared with other photographic processes, such as an electrophotographic process or a diazo photographic process. In recent years, with respect to image formation processes for photographic materials using silver halide, many techniques capable of easily and quickly obtaining images have been developed by changing the conventional wet process using a developing solution into a dry development process such as a process using heat, etc.

Heat-developable photographic materials are known in the field of these techniques. Heat-developable photographic materials and processes therefor have been described in U.S. Pat. Nos. 3,152,904, 3,301,678, 3,392,020 and 3,457,075, British Pat. Nos. 1,131,108 and 1,167,777, and *Research Disclosure,* No. 17029, pages 9 to 15 (June, 1978).

Many different processes for obtaining color images have been proposed. With respect to processes for forming color images by the reaction of an oxidation product of a developing agent with a coupler, it has been proposed to use a p-phenylenediamine type reducing agent and a phenolic coupler or an active methylene coupler as described in U.S. Pat. No. 3,531,286, a p-aminophenol type reducing agent as described in U.S. Pat. No. 3,761,270, a sulfonamidophenol type reducing agent as described in Belgian Pat. No. 802,519 and *Research Disclosure,* pages 31 and 32 (September, 1975) and the combination of a sulfonamidophenol type reducing agent and a 4-equivalent coupler as described in U.S. Pat. No. 4,021,240. These processes, however, are disadvantageous in that turbid color images are formed, because a reduced silver image and a color image are simultaneously formed on the exposed area after heat development. In order to eliminate these disadvantages, there have been proposed a process which comprises removing a silver image by liquid processing or a process which comprises transferring only the dye to another layer, for example, a sheet having an image receiving layer. However, the latter process is not desirable because it is not easy to transfer only the dye as distinguishable from unreacted substances.

Another process which comprises introducing a nitrogen containing heterocyclic group into a dye, forming a silver salt and releasing a dye by heat development has been described in *Research Disclosure,* No. 16966, pages 54 to 58 (May, 1978). According to this process, clear images cannot be obtained, because it is difficult to control the release of dyes from non-exposed areas, and thus it is not a conventionally applicable process.

Also, processes for forming a positive color image by a heat-sensitive silver dye bleach process, with useful dyes and methods for bleaching have been described, for example, in *Research Disclosure,* No. 14433, pages 30 to 32 (April, 1976), ibid., No. 15227, pages 14 and 15 (December, 1976) and U.S. Pat. No. 4,235,957.

However, this process requires an additional step and an additional material for accelerating bleaching of dyes, for example, heating with a superposed sheet with an activating agent. Furthermore, it is not desirable because the resulting color images are gradually reduced and bleached by coexisting free silver during long periods of preservation.

Moreover, a process for forming a color image utilizing a leuco dye has been described, for example, in U.S. Pat. Nos. 3,985,565 and 4,022,617. However, this process is not desirable because it is difficult to stably incorporate the leuco dye in the photographic material and coloration gradually occurs during preservation.

Furthermore, these processes described above generally have disadvantages that a relatively long time is required for development and that color images having high level of fog and a low density are obtained.

SUMMARY OF THE INVENTION

The present invention provides a photographic material for forming a color image by heat development, eliminating the drawbacks present in known materials.

Therefore, an object of the present invention is to provide a process for obtaining a color image having a high density in a short time.

Another object of the present invention is to provide a process for obtaining a color image having not only a high density but also a low level of fog.

Still another object of the present invention is to provide a novel process for forming a color image which comprisess heat transferring a hydrophilic dye released upon heat development into an image receiving material containing a mordant to obtain a color image.

A further object of the present invention is to provide a process for obtaining a clear color image by a simple procedure.

A still further object of the present invention is to provide a process for obtaining a color image which is stable for a long period of time.

These and other objects of the present invention will become more apparent from the following detailed description and examples.

These objects of the present invention are accomplished with a heat-developable color photographic material comprising a support having thereon at least a light-sensitive silver halide, a hydrophilic binder, a dye releasing material being reductive and capable of releasing a hydrophilic dye and a compound represented by the following general formula (A):

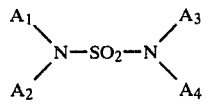

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group, or $A_1$ and $A_2$ or $A_3$ and $A_4$ may combine with each other to form a ring.

DETAILED DESCRIPTION OF THE INVENTION

The compounds represented by the general formula (A) are described in detail below. Preferable examples of the alkyl group have 1 to 18 carbon atoms and more preferably include a methyl group, an ethyl group, an isopropyl group, a propyl group, a butyl group, an isobutyl group, an octyl group, etc. Preferable examples of substituents for the substituted alkyl group include an alkoxy group having 1 to 18 carbon atoms (such as a methoxy group, etc.), a hydroxy group, a cyano group, a halogen atom, etc. Preferable examples of the aryl group have 6 to 18 carbon atoms and include a phenyl group, a naphthyl group, etc. Preferable examples of substituents for the substituted aryl group include an alkyl group having 1 to 18 carbon atoms (such as a methyl group, etc.), a cyano group, a nitro group, a halogen atom, etc. Preferable examples of the cycloalkyl group have 3 to 18 carbon atoms and include a cyclohexyl group, etc. Preferable exampless of the aralkyl group have 7 to 18 carbon atoms and include a benzyl group, etc. Preferable examples of the ring formed with $A_1$ and $A_2$ or $A_3$ and $A_4$ include a 5- or 6-membered heterocyclic ring which contains a nitrogen atom, an oxygen atom and/or a sulfur atom, and may compose a condensed ring, and preferably include

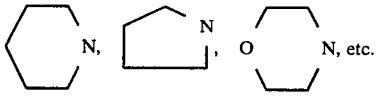

Specific examples of the compounds represented by the general formula (A) are shown below, but the present invention is not to be construed as being limited thereto.

$H_2NSO_2NH_2$, $H_2NSO_2NHCH_3$, $H_2NSO_2NHC_2H_5$, $H_2NSO_2NHC_3H_7$, $H_2NSO_2NHC_3H_7$(iso), $H_2NSO_2NHC_4H_9$, $H_2NSO_2NHC_4H_9$(iso), $H_2NSO_2NHC_4H_9$(sec), $H_2NSO_2NHC_4H_9$(tert), $H_2NSO_2NHC_5H_{11}$, $H_2NSO_2NHC_6H_{13}$, $H_2NSO_2NHC_8H_{17}$, $H_2NSO_2N(CH_3)_2$, $H_2NSO_2N(C_2H_5)_2$, $H_2NSO_2N(C_3H_7)_2$, $H_2NSO_2N(C_3H_7\text{-iso})_2$, $H_2NSO_2N(C_4H_9)_2$, $CH_3NHSO_2NHCH_3$, $CH_3NHSO_2N(CH_3)_2$, $(CH_3)_2NSO_2N(CH_3)_2$, $(C_2H_5)_2NSO_2N(C_2H_5)_2$,

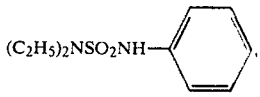

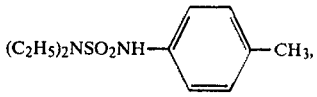

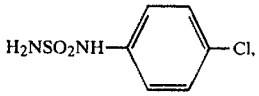

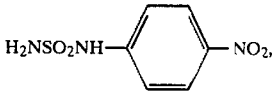

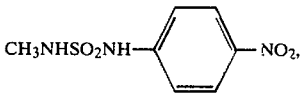

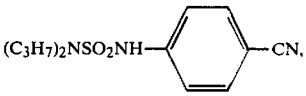

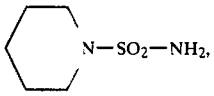

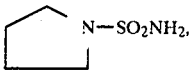

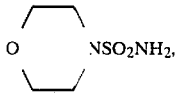

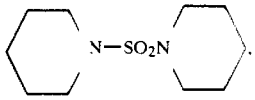

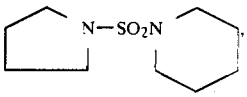

-continued

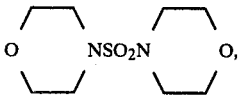

$H_2NSO_2N(C_2H_4OH)_2$,
$H_2NSO_2N(C_2H_4OC_2H_4OH)_2$,
$H_2NSO_2N(C_2H_4OCH_3)_2$,

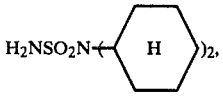

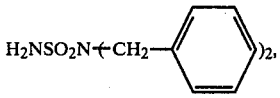

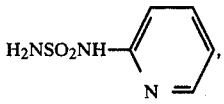

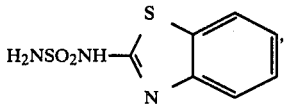

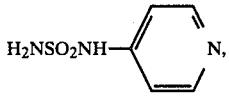

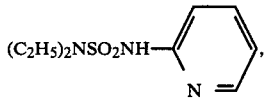

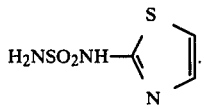

Of the compounds represented by the general formula (A), those in which at least one of $A_1$, $A_2$, $A_3$ and $A_4$ is a hydrogen atom are particularly preferred. Examples of such compounds are shown below.

$H_2NSO_2NH_2$, $H_2NSO_2N(CH_3)_2$, $H_2NSO_2N(C_2H_5)_2$, $H_2NSO_2N(C_3H_7)_2$, $H_2NSO_2NHCH_3$, $CH_3NHSO_2NHCH_3$, $CH_3NHSO_2N(CH_3)_2$, $H_2NSO_2N(C_2H_4OH)_2$, $C_2H_5NHSO_2NH_2$, $C_2H_5NHSO_2NHC_2H_5$, $C_2H_5NHSO_2N(C_2H_5)_2$,

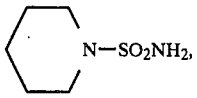

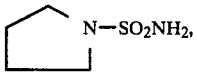

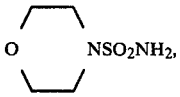

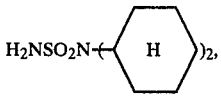

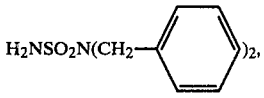

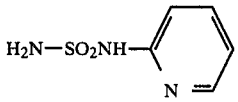

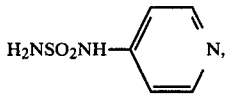

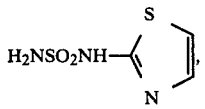

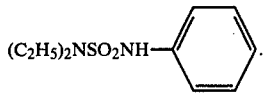

A synthesis method of the compound represented by the general formula (A) according to the present invention is described below.

The compound represented by the general formula (A) according to the present invention can be generally obtained by a reaction of a sulfamoyl chloride derivative described below with an amine as illustrated in the following scheme.

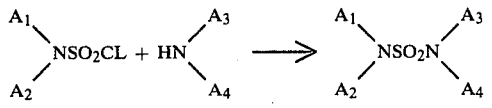

The sulfamoyl chloride derivative which is one of the raw materials can be easily obtained from the corresponding amine and sulfuryl chloride according to the method described in the literature, for example, *Ann. Chem.*, Vol. 729, pages 40 to 51 (1969), etc. The condensation reaction of a sulfamoyl chloride derivative with an amine is usually carried out in an aprotic solvent such as acetonitrile, ether, tetrahydrofuran, etc., at a temperature of 20° to 50° C. using an excess amount of the amine whereby the desired compound can be obtained in a high yield. Synthesis example of the compound according to the present invention is specifically described below.

SYNTHESIS EXAMPLE

Synthesis of N,N-Dimethylsulfamide $(CH_3)_2NSO_2NH_2$ 1,440 g of dimethylsulfamoyl chloride was dissolved in 3 liters of acetonitrile and into the solution was introduced an ammonia gas at a rate of 1 liter per minute for 15 hours with stirring at 20° to 30° C. until the ammonia gas was not absorbed. The white crystals precipitated were separated by filtration and washed with 1 liter of acetonitrile. The filtrate and the wash liquid were mixed together and the acetonitrile was distilled off under reduced pressure. The residue was recrystallized from 2.5 liters of isopropanol to obtain 1,050 g of N,N-dimethylsulfamide as white plate crystals. Melting point: 96° to 97° C.

Other sulfamide derivatives were synthesized in the same manner as described above. Some examples thereof are shown below.

| $A_1$ | $A_2$ | $A_3$ | $A_4$ | Melting Point |
|---|---|---|---|---|
| H | H | H | H | 92° C. |
| H | H | $C_2H_5$ | $C_2H_5$ | 42 to 43° C. |
| H | H | $C_3H_7$ | $C_3H_7$ | 62 to 63° C. |
| $C_2H_5$ | $C_2H_5$ | $C_2H_5$ | $C_2H_5$ | liquid |
| $C_2H_5$ | $C_2H_5$ | H | 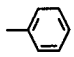 | liquid |
| $C_2H_5$ | $C_2H_5$ | H | $C_4H_9$ | liquid |

The compounds according to the present invention can be used solely or as a mixture of two or more thereof.

The reason for which the compound according to the present invention is effectively employed is not entirely clear.

The compound according to the present invention may be used together with a dye releasing activator described hereinafter.

The compound (A) according to the present invention can be used in an amount of a broad range. It is preferably used in an amount in the range of 1/100 to 10 times and, particularly, 1/20 to 2 times by molar ratio based on silver.

The heat-developable color photographic material of the present invention can simultaneously provide a silver image having a negative-positive relationship to the original and a diffusible dye on the part corresponding to the silver image utilizing only heat development after imagewise exposure to light. That is, when the heat-developable color photographic material of the present invention is imagewise exposed to light and developed by heating, an oxidation-reduction reaction occurs between an exposed light-sensitive silver halide and a reductive dye releasing compound to form a silver image in the exposed area. In this step, the dye releasing compound is oxidized by the silver halide to form an oxidized product. This oxidized product is cleaved and consequently the hydrophilic diffusible dye is released. Accordingly, the silver image and the diffusible dye are formed in the exposed area, and a color image is obtained by transferring the diffusible dye.

The reaction of releasing a diffusible dye according to the present invention is completed with a dye film under high temperature, although the releasing reaction of a diffusible dye is usually carried out in a liquid. In the present invention, the compounds which are set forth as preferred examples show a high reaction rate even in the dry film, although the rate varies depending on a kind of the dye releasing compounds. The reaction rates found were unexpectedly high. Further, the dye releasing compound according to the present invention can undergo an oxidation-reduction reaction with silver halide without the assistance of the so-called auxiliary developing agent. This is also an unexpected result based on previous information of what may happen at ambient temperature.

The above-described reaction is particularly accelerated in the presence of an organic silver salt oxidizing agent to provide a high color density. Therefore, it is a particularly preferred embodiment in which the organic silver salt oxidizing agent is coexistent.

The dye releasing reductive compound which releases a hydrophilic diffusible dye used in the present invention is represented by the following general formula (I):

$$R—SO_2—D \qquad (I)$$

wherein R respresents a reducing group capable of being oxidized by the silver halide; and D represents an image forming dye portion containing a hydrophilic group.

Preferably the reducing group R in the dye releasing compound $R\text{-}SO_2\text{-}D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group include those represented by the following general formulae (II) to (IX).

(II)

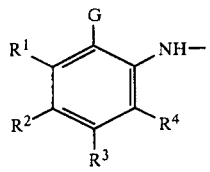

(III)

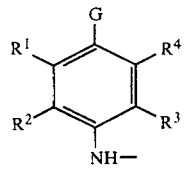

(IV)

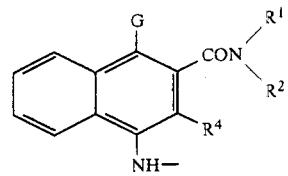

(V)

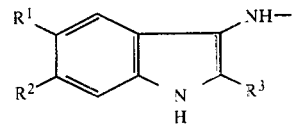

-continued (VI)

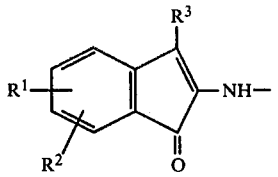

(VII)

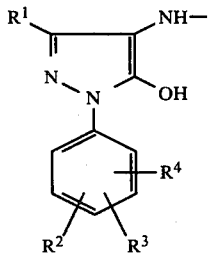

(VIII)

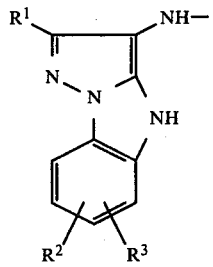

(IX)

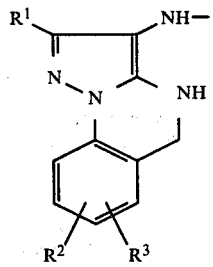

wherein G represents a hydroxy group or a group giving a hydroxy group upon hydrolysis, and $R^1$, $R^2$, $R^3$ and $R^4$ each represents a hydrogen atom, an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above-described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. The total number of the carbon atoms of substituents represented by $R^1$, $R^2$, $R^3$ and $R^4$ is preferably from 8 to 40. Furthermore, the hydroxy group and the amino group included in the reducing group represented by R may be protected by a protective group capable of reproducing the hydroxy group and the amino group by the action of a nucleophilic agent.

In more preferred embodiments of the present invention, the reducing group R is represented by the following general formula (X).

(X)

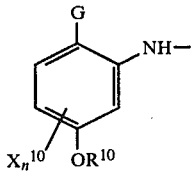

wherein G represents a hydroxy group or a group giving a hydroxy group upon hydrolysis; $R^{10}$ represents an alkyl group or an aromatic group; $X^{10}$ represents an electron donating substituent when n is 1 or substituents, which may be the same or different, one of the substituents being an electron donating group and the second or second and third substituents being selected from an electron donating group or a halogen atom when n is 2 or 3; wherein $X^{10}$ groups may form a condensed ring with each other or with $OR^{10}$; n is 1, 2 or 3 and the total carbon number of $X^{10}_n$ and $R^{10}$ is from 8 to 40.

Of the reducing groups represented by the general formula (X), more preferred reducing groups R are represented by the following general formulae (Xa) and (Xb):

(Xa)

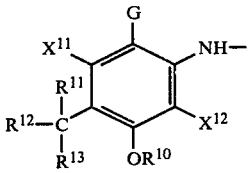

wherein G represents a hydroxy group or a group having a hydroxy group upon hydrolysis; $R^{11}$ and $R^{12}$, which may be the same or different, each represents an alkyl group having 1 to 12 carbon atoms or $R^{11}$ and $R^{12}$ may be bonded to each other to form a ring; $R^{13}$ represents a hydrogen atom or an alkyl group having 1 to 12 carbon atoms; $R^{10}$ represents an alkyl group or an aromatic group each having 4 to 22 carbon atoms; $X^{11}$ and $X^{12}$, which may be the same or different, each represents a hydrogen atom, an alkyl group, an alkoxy group, a halogen atom, an acylamino group or an alkylthio group each having up to 12 carbon atoms; and $R^{10}$ and $X^{12}$ or $R^{10}$ and $R^{13}$ may be bonded to each other to form a ring, (Xb)

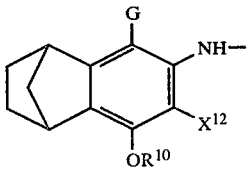

wherein G represents a hydroxy group or a group giving a hydroxy group upon hydrolysis; $R^{10}$ represents an alkyl group having 4 to 22 carbon atoms or an aromatic group having 6 to 22 carbon atoms; $X^{12}$ represents a hydrogen atom, an alkyl group, an alkoxy group, a halogen atom, an acylamino group or an alkylthio group each having up to 12 carbon atoms; and $R^{10}$ and $X^{12}$ may be bonded to each other to form a ring.

Specific examples of the reducing groups represented by the above-described general formulae (X), (Xa) and (Xb) are described in U.S. Pat. No. 4,055,428 (incorporated herein by reference to disclose such), Japanese Patent Application (OPI) Nos. 12642/81 and 16130/81 (the term "OPI" as used herein refers to a "published unexamined Japanese patent application").

In other more preferred embodiments of the present invention, the reducing group R is represented by the following general formula (XI).

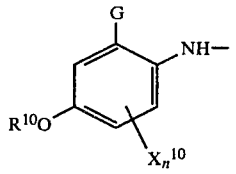

(XI)

wherein G, $R^{10}$, $X^{10}$ and n each has the same meaning as defined in the general formula (X).

Of the reducing groups represented by the general formula (XI), more preferred reducing groups R are represented by the following general formulae (XIa), (XIb) and (XIc)

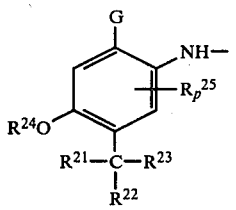

(XIa)

wherein G represents a hydroxy group or a group giving a hydroxy group upon hydrolysis; $R^{21}$ and $R^{22}$, which may be the same or different, each represents an alkyl group or an aromatic group, and $R^{21}$ and $R^{22}$ may be bonded to each other to form a ring; $R^{23}$ represents a hydrogen atom, an alkyl group or an aromatic group; $R^{24}$ represents an alkyl group or an aromatic group; $R^{25}$ represents an alkyl group, an alkoxy group, an alkylthio group, an arylthio group, a halogen atom or an acylamino group; p is 0, 1 or 2; $R^{24}$ and $R^{25}$ may be bonded to each other to form a condensed ring; $R^{21}$ and $R^{24}$ may be bonded to each other to form a condensed ring; $R^{21}$ and $R^{25}$ may be bonded to each other to form a condensed ring; and the total number of the carbon atoms included in $R^{21}$, $R^{22}$, $R^{23}$, $R^{24}$ and $R^{25}{}_p$ is from 7 to 40.

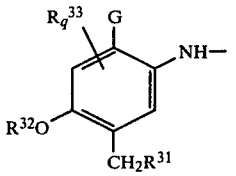

(XIb)

wherein G represents a hydroxy group or a group giving a hydroxy group upon hydrolysis; $R^{31}$ represents an alkyl group or an aromatic group; $R^{32}$ represents an alkyl group or an aromatic group; $R^{33}$ represents an alkyl group, an alkoxy group, an alkylthio group, an arylthio group, a halogen atom or an acylamino group; q is 0, 1 or 2; $R^{32}$ and $R^{33}$ may be bonded to each other to form a condensed ring; $R^{31}$ and $R^{32}$ may be bonded to each other to form a condensed ring; $R^{31}$ and $R^{33}$ may be bonded to each other to form a condensed ring; and the total number of the carbon atoms included in $R^{31}$, $R^{32}$ and $R^{33}{}_q$ is from 7 to 40.

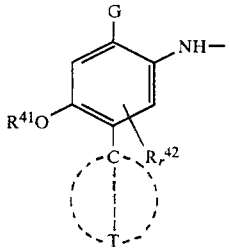

(XIc)

wherein G represents a hydroxy group or a group giving a hydroxy group upon hydrolysis; $R^{41}$ represents an alkyl group or an aromatic group; $R^{42}$ represents an alkyl group, an alkoxy group, an alkylthio group, an arylthio group, a halogen atom or an acylamino group; r is 0, 1 or 2; the group of

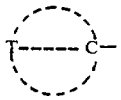

represents a group in which 2 to 4 saturated hydrocarbon rings are condensed, the carbon atom

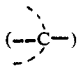

in the condensed ring which is connected to the phenol nucleus (or a precursor thereof), a tertiary carbon atom which composes one of the pivot of the condensed ring, a part of the carbon atoms (excluding the above-described tertiary carbon atom) in the hydrocarbon ring may be substituted for oxygen atom(s), the hydrocarbon ring may have a substituent, and an aromatic ring may be further condensed to the hydrocarbon ring; $R^{41}$ or $R^{42}$ and the group of

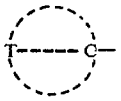

may be bonded to each other to form a condensed ring; and the total number of the carbon atoms included in $R^{41}$, $R^{42}{}_r$ and the group of

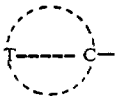

is from 7 to 40.

Specific examples of the reducing groups represented by the above-described general formulae (XI), (XIa), (XIb) and (XIc) are described in Japanese Patent Application (OPI) Nos. 16131/81 (corresponding to U.S. Pat. No. 4,336,322), 650/82 and 4043/82.

The essential part in the groups represented by the general formuale (III) and (IV) is a para(sulfonyl-)aminophenol part. Specific examples of these reducing groups are described in U.S. Pat. Nos. 3,928,312 and 4,076,529, U.S. Published Patent Application B 351,673, U.S. Pat. Nos. 4,135,929 and 4,258,120. These groups are also effective for the reducing group R according to the present invention.

In still other more preferred embodiments of the present invention, the reducing group R is represented by the following general formula (XII).

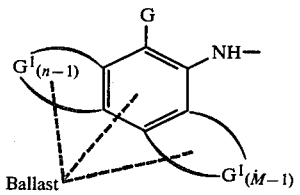

(XII)

wherein Ballast represents a diffusion-resistant group; G represents a hydroxy group or a precursor of a hydroxy group; $G^1$ represents an aromatic ring directly condensed to the benzene nucleus to form a naphthalene nucleus; and n and m are dissimilar positive integers of 1 to 2.

Specific examples of the reducing groups represented by the above-described general formula (XII) are described in U.S. Pat. No. 4,053,312.

The reducing groups represented by the above-described general formulae (V), (VII), (VIII) and (IX) are characterized by containing a heterocyclic ring. Specific examples of the groups are described in U.S. Pat. Nos. 4,198,235 and 4,273,855, Japanese Patent Application (OPI) No. 46730/78.

Specific examples of the reducing groups represented by the general formula (VI) are described in U.S. Pat. No. 4,149,892.

Characteristics required for the reducing group R are as follows.

1. It is rapidly oxidized by the silver halide to effectively release a diffusible dye for image formation by the function of the dye releasing activator.

2. The reducing group R has an extensive hydrophobic property, because it is necessary for the dye releasing redox compound to be immobilized in a hydrophilic or hydrophobic binder and that only the released dye have diffusibility.

3. It has excellent stability to heat and to the dye releasing activator and does not release the image forming dye until it is oxidized; and 4. It is easily synthesized.

In the following, specific examples of preferred reducing groups R which satisfy the above-described requirements are shown. In the examples, NH— represents the bond to the dye portion.

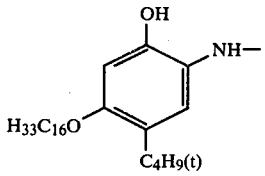

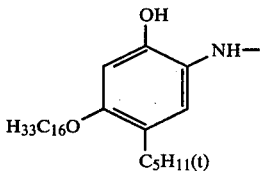

-continued

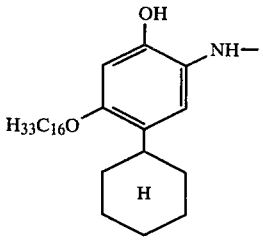

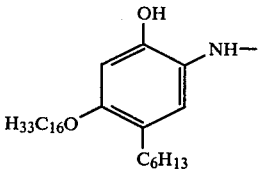

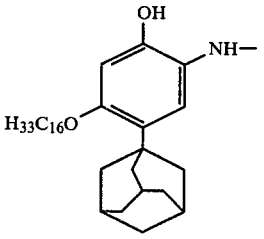

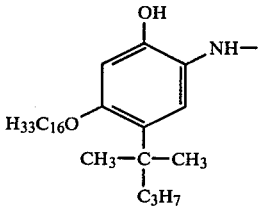

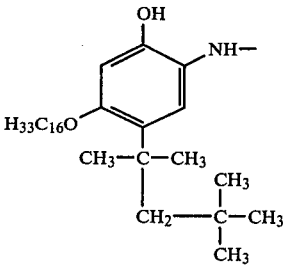

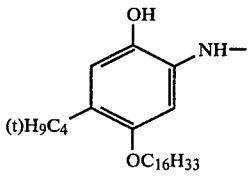

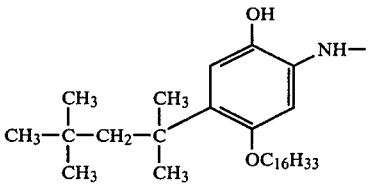

-continued

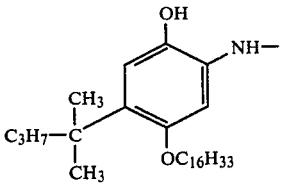

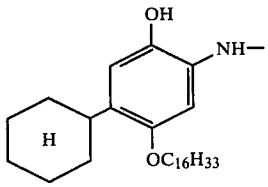

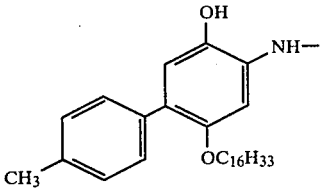

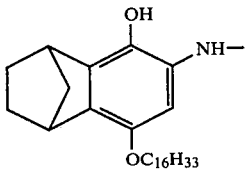

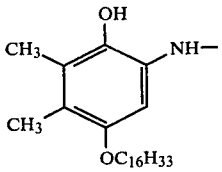

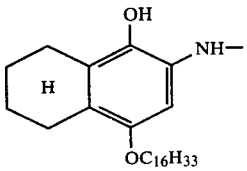

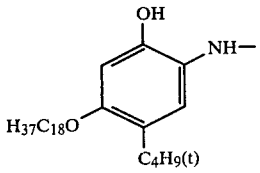

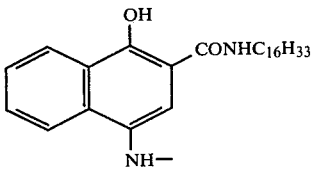

-continued

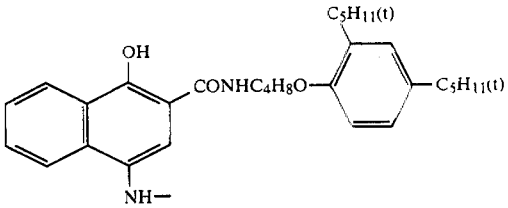

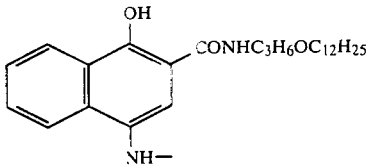

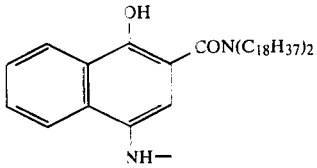

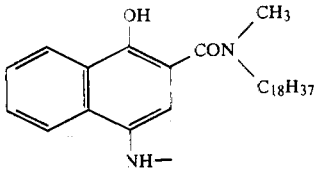

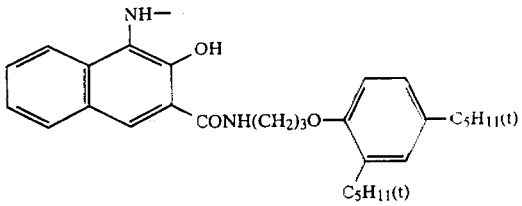

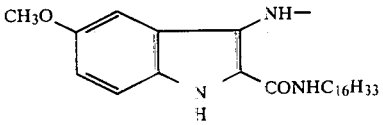

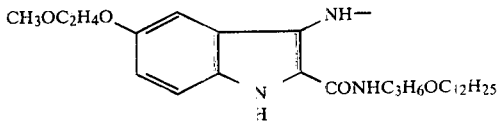

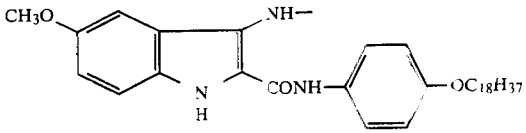

Examples of dyes which can be used for image forming dyes include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow:
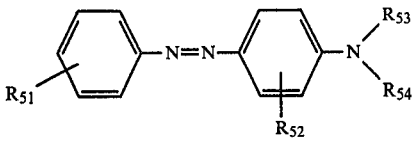
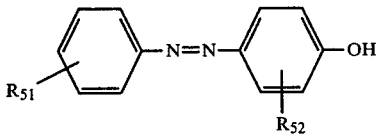
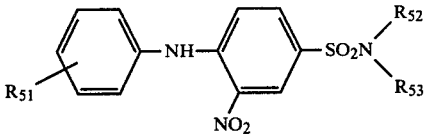
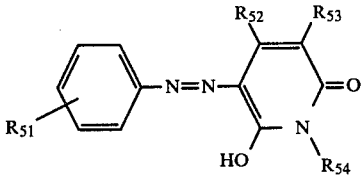
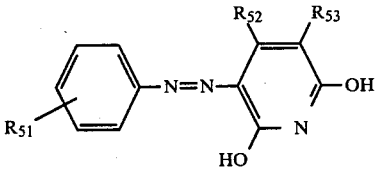
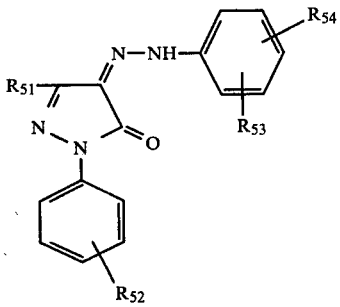
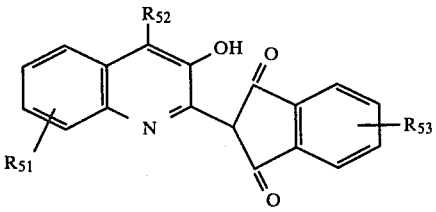
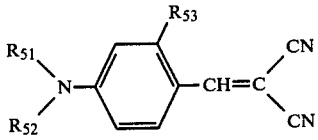
-continued
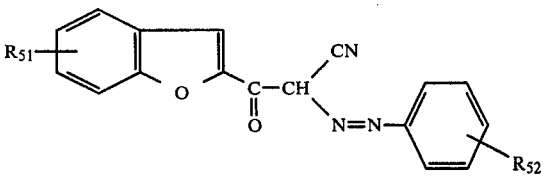
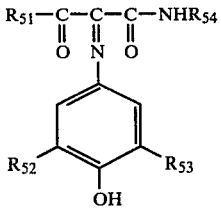
Magenta:
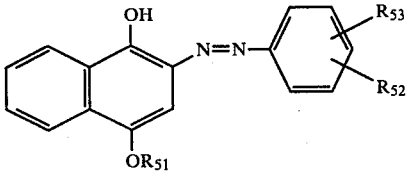
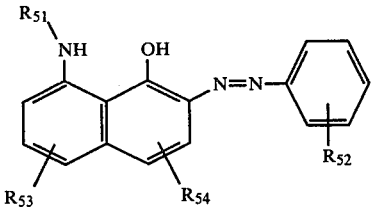
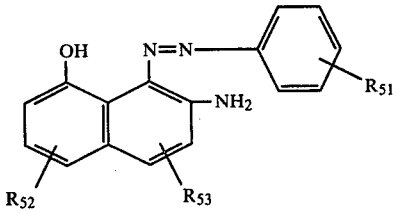
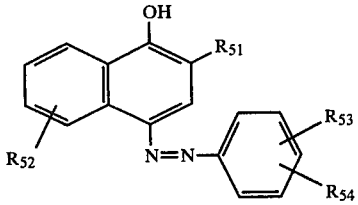
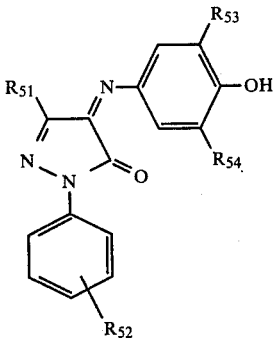

-continued
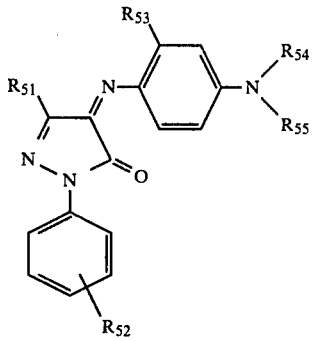
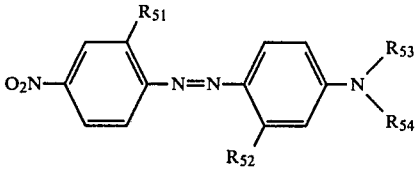
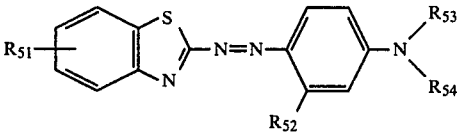
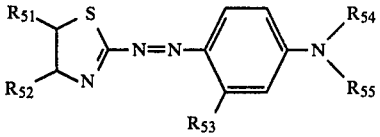
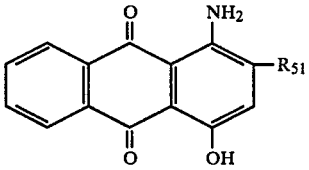
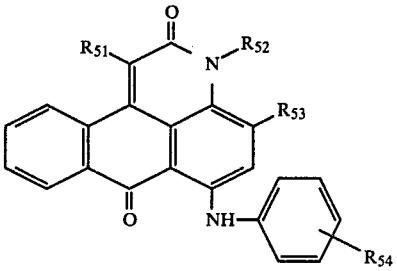
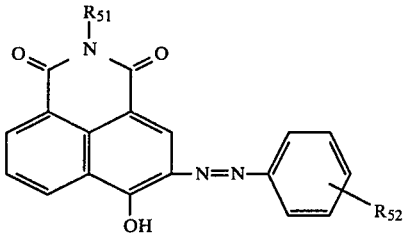
Cyan:
-continued
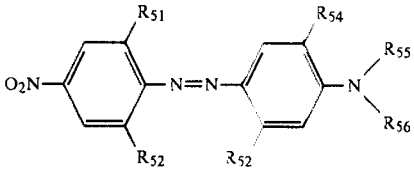
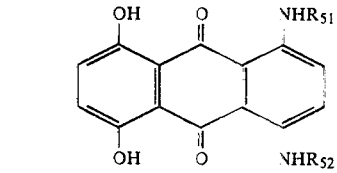
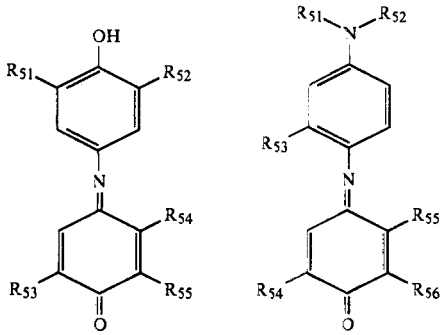
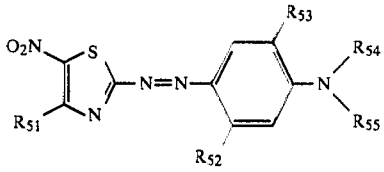
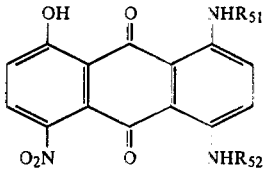
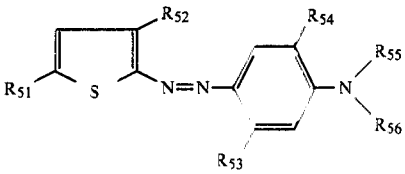
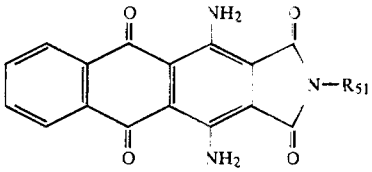

-continued

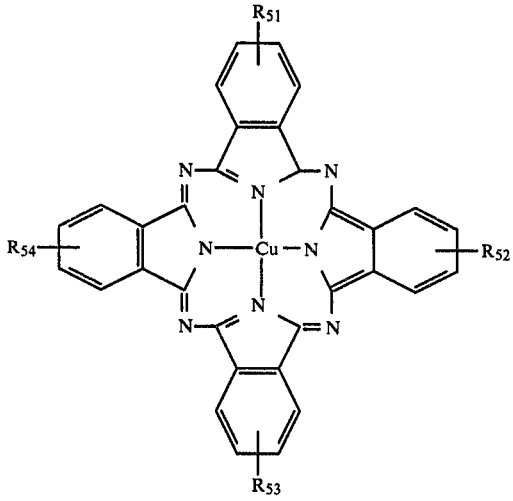

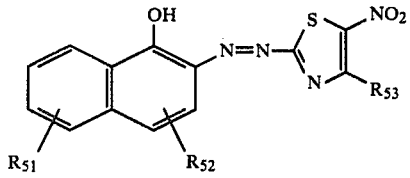

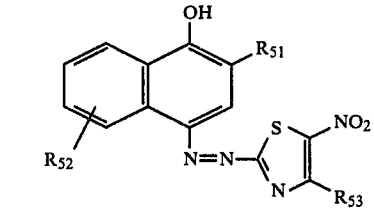

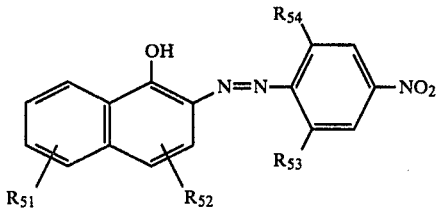

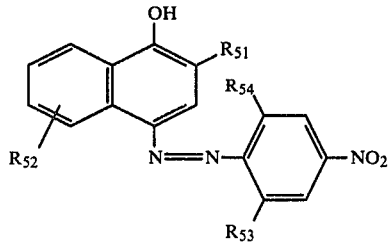

wherein $R^{51}$ to $R^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above-described substituents may be further substituted with halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group. It is preferred that the number of the carbon atoms of substituents represented by $R^{51}$, $R^{52}$, $R^{53}$, $R^{54}$, $R^{55}$ and $R^{56}$ is up to 16 and the total number of the carbon atoms of substituents represented by $R^{51}$ to $R^{56}$ is up to 25.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition (pKa<12) are particularly preferred. Examples of these grpoups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Specific examples of preferred image forming dyes which satisfy the above-described requirements are described in the following, wherein the end group $-SO_2NH_2$ in these dyes represents a group necessary to bond to the reducing group R.

Yellow

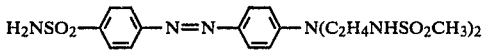

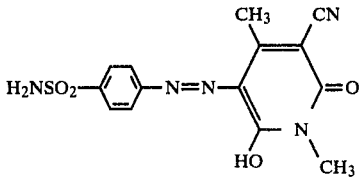

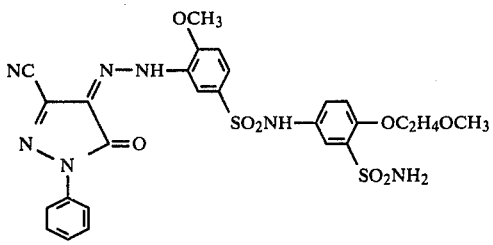

-continued
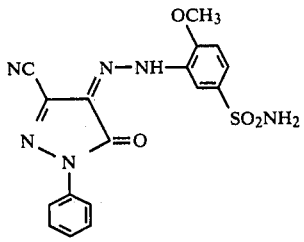
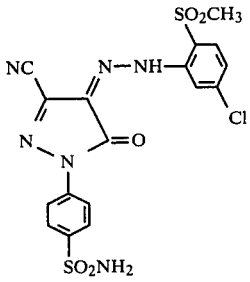
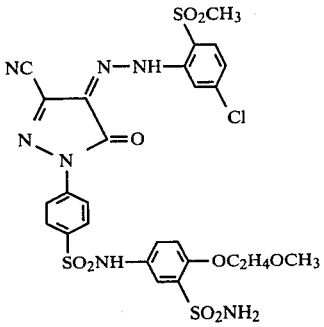
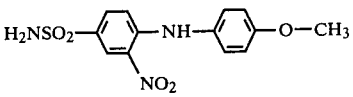
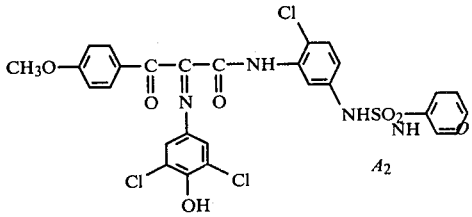
$A_2$
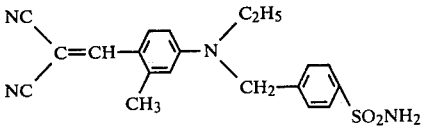
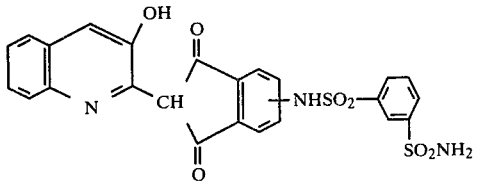
Magenta
-continued
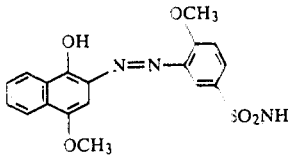
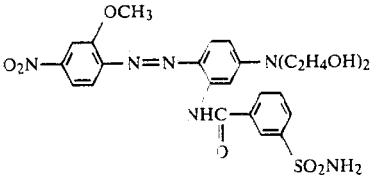
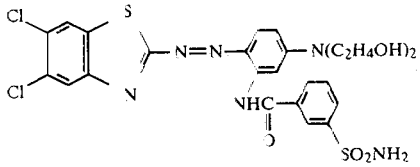
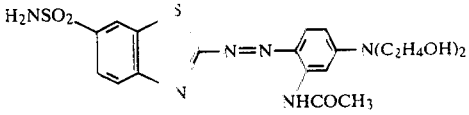
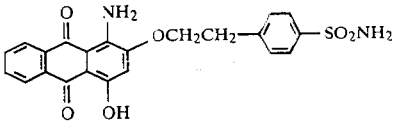
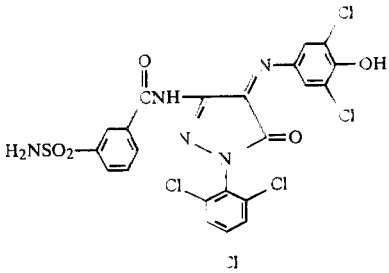
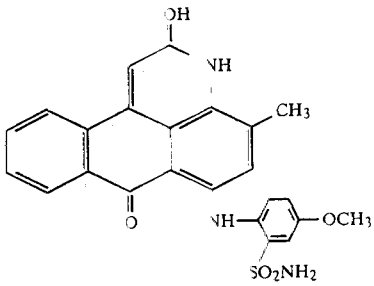
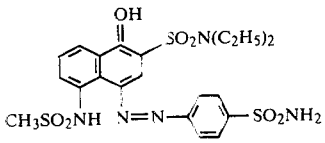

-continued

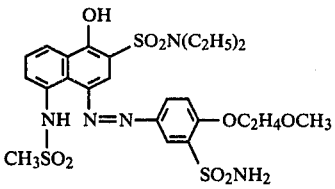

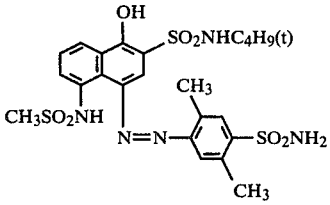

Cyan

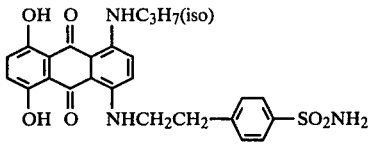

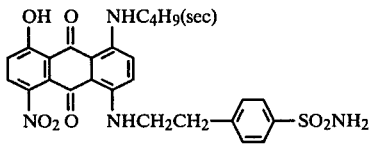

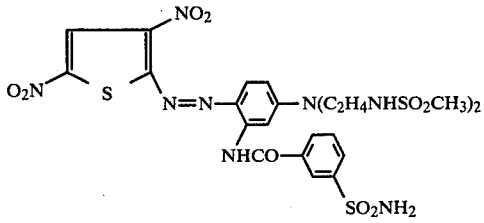

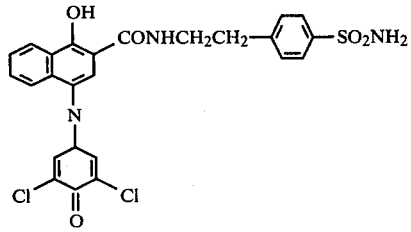

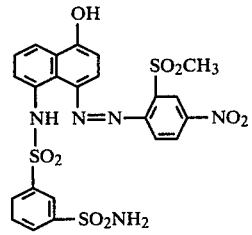

-continued

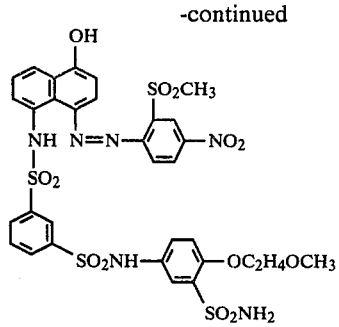

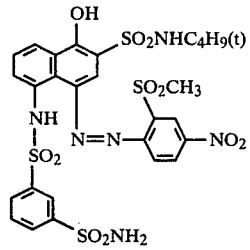

As the dye releasing compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published Patent Application B 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above-described specific example.

Further, the dye releasing compounds which release a yellow dye as described, for example, in U.S. Pat. Nos. 4,013,633, 4,156,609, 4,148,641, 4,165,987, 4,148,643, 4,183,755, 2,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye releasing compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Processes for synthesizing the dye releasing compounds are described below.

Generally, the dye releasing compounds used in the present invention are obtained by condensing an amino group included in the reducing group R with a chlorosulfonyl group included in the image forming dye portion D.

The amino group of the reducing group R can be introduced by reduction of a nitro group, a nitroso group or an azo group or by ring-opening reaction of benzoxazoles and may be used as a free base or may be used as a salt of an inorganic acid. Further, the chlorosulfonyl group of the image forming dye portion D is obtaoned by converting the corresponding sulfonic acid or salts thereof using a chlorinating agent such as phosphorus oxychloride, phosphorus pentachloride or thionyl chloride, etc., according to a conventional method.

The condensation reaction of the reducing group R with the image forming dye portion D can be generally carried out in an aprotic polar solvent such as dimethylformamide, dimethylacetamide, dimethyl sulfoxide, N-methylpyrrolidone or acetonitrile, etc., in the presence of an organic base such as pyridine, picoline, lutidine, triethylamine or diisopropylethylamine, etc., at 0° to 5° C. by which the desired dye releasing compound can usually be obtained in a high yield.

The details of synthesis of the dye releasing compounds are set forth in Japanese Patent Application No. 157798/81.

The dye releasing compound which releases a diffusible dye according to the present invention can be used in an amount of a fixed range. Generally, a suitable range is about 0.01 mol to about 4 mols of the dye releasing compound per mol of the silver halide. A particularly suitable amount in the present invention is in a range of about 0.03 to about 1 mol per mol of the silver halide.

In the present invention, if necessary, a reducing agent may be used. The reducing agent in this case is the so-called auxiliary developing agent, which is oxidized by the silver salt oxidizing agent to form its oxidized product having an ability to oxidize the reducing group R in the dye releasing compound.

Examples of useful auxiliary developing agents include hydroquinone, alkyl substituted hydroquinones such as tertiary butyl hydroquinone or 2,5-dimethylhydroquinone, catechols, pyrogallols, halogen substituted hydroquinones such as chlorohydroquinone or dichlorohydroquinone, alkoxy substituted hydroquinones such as methoxyhydroquinone, and polyhydroxybenzene derivatives such as methyl hydroxynaphthalene, etc. Further, there are methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone or 4-methyl-4-hydroxymethyl-1-phenyl-3-pyrazolidone, etc., reductones and hydroxy tetronic acids.

The auxiliary developing agent can be used in an amount of a fixed range. A suitable range is 0.01 time by mol to 20 times by mol based on the silver halide. A particularly suitable range is 0.1 time by mol to 4 times by mol.

Examples of silver halide include silver chloride, silver chlorobromide, silver chloroiodide, silver bromide, silver iodobromide, silver chloroiodobromide and silver iodide, etc.

Particularly preferred examples of silver halide used in the present invention partially contain a silver iodide crystal in its particle. That is, the silver halides the X-ray diffraction pattern of which shows that of pure silver iodide are particularly preferred.

In photographic light-sensitive materials, silver halides containing at least two silver halides each having different halogen may be used. Such silver halides yield a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and thus showing the X-ray diffraction pattern of pure silver iodide crystal.

The process for preparing those silver halides is explained taking the case of silver iodobromide. That is, the silver iodobromide is prepared by adding silver nitride solution to potassium bromide solution to form silver bromide particles and further adding potassium iodide to the mixing solution.

The silver halide has a particle size of from 0.001 μm to 2 μm and preferably from 0.001 μm to 1 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process*, the Fourth Edition, Chapter 5, pages 149–169.

In the particularly preferred embodiment according to the present invention, an organic silver salt oxidizing agent is used together.

The organic silver salt oxidizing agent which can be used in the present invention is a silver salt which is comparatively stable to light and which forms a silver image by reacting with the above-described image forming compound or a reducing agent coexisting, if necessary, with the image forming compound, when it is heated to a temperature of above 80° C. and preferably above 100° C. in the presence of exposed silver halide. By employing the organic silver salt oxidizing agent, the photographic material capable of forming images having a high color density can be obtained.

An amount of the organic silver salt oxidizing agent used in the present invention is from 0 to 100 mols, and preferably from 0.2 to 10 mols per mol of the silver halide.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate, and silver camphorate, etc. These silver salts which are substituted with a halogen atom or a hydroxyl group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione or the like as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercapto-benzothiazole, a silver salt of 2-(S-ethylglycolamido)-benzothiazole, a silver salt of thioglycolic acid such as a silver salt of an S-alkyl thioglycolic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt and an organic metal salt such as copper stearate, etc., as described in *Research Disclosure,* Vol. 170, No. 17029 (June, 1978) are examples of the organic metal salt oxidizing agent capable of being used in the present invention.

The mechanism of the heat development process under heating in the present invention is not entirely clear, but it is believed to be as follows.

When the photographic material is exposed to light, a latent image is formed in a light-sensitive silver halide. This phenomenon is described in T. H. James, *The Theory of the Photographic Process,* Third Edition, pages 105 to 148.

When the photographic material is heated, the reducing agent, the dye releasing compound, in the case of the present invention reduces the silver halide or the silver halide and the organic silver salt oxidizing agent in the presence of the latent image nuclei as a catalyst to form silver, while it is oxidized itself. The oxidized product of the dye releasing compound is cleaved to release a dye.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 mg to 10 g/m$^2$ calculated as an amount of silver.

The light-sensitive silver halide and the organic silver salt oxidizing agent used in the present invention are prepared in a binder as described below. Further, the dye releasing compound is dispersed in the binder described below.

The binder which can be used in the present invention can be employed individually or in a combination of two or more. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

In the heat-developable color photographic material of the present invention, various kinds of dye releasing activator may be used. The dye releasing activators used include bases, base releasing agents and water releasing compounds. Of these dye releasing activators, the bases and the base releasing agents are particularly preferred because they not only accelerate release of the dye but also accelerate the oxidation-reduction reaction between the silver halide or the organic silver salt oxidizing agent and the dye releasing compound.

Examples of preferred bases are amines which include trialkylamines, hydroxylamines, aliphatic polyamides, N-alkyl subsituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base releasing agent is a substance which releases a basic component by heating. Examples of typical base releasing agent have been described in British Pat. No. 998,949. A preferred base releasing agent is a salt of a carboxylic acid and an organic base, and examples of the suitable carboxylic acid include trichloroacetic acid and trifluoroacetic acid and examples of suitable base include guanidine, piperidine, morpholine, p-toluidine and 2-picoline, etc. Guanidine trichloroacetic acid as described in U.S. Pat. No. 3,220,846 is particularly preferred. Further, aldonic amides are described in Japanese Patent Application (OPI) No. 22625/75 are suitably used because they decompose at a high temperature to form a base.

The water releasing compound means a compound which releases water by decomposition during heat development to convert into a compound having a vapor pressure of $10^{-5}$ Torr or more at a temperature of 100° to 200° C. These compounds are known in the field of printing of fabrics, and $NH_4Fe(SO_4)_2.12H_2O$. etc., as described in Japanese Patent Application (OPI) No. 88386/75 are useful.

These dye releasing activators can be used in an amount of a broad range. It is preferably used in an amount in the range of 1/100 to 10 times and particularly from 1/20 to 2 times by molar ratio based on silver.

Further, in the heat-developable color photographic material of the present invention, it is possible to use compounds which activate development simultaneously while stabilizing the images. Particularly, it is suitable to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having $\alpha$-sulfonylacetate as an acid part such as bis(2-amino-2-thiazolium)methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

These compounds or mixtures thereof can be used in a wide range of amounts. It is preferable to use them in a range of 1/100 to 10 times and particularly 1/20 to 2 times by molar ratio based on silver.

In the heat-developable color photographic material of the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as oleic acid ester, etc., beeswax, monostearin, compounds having a high dielectric constant which have —$SO_2$— or —CO— such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 December 1976), etc.

The heat-developable color photographic material of the present invention may contain a polyethylene glycol type nonionic surface active agent having a repeating unit of ethylene oxide in its molecule. It is particularly preferred that the compound contains 5 or more of the repeating units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schöufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agent can be used in an amount of less than 100% by weight, preferably less than 50% by weight, based on a hydrophilic binder.

The photographic material of the present invention may contain a cationic compound having a pyridinium group. Examples of the cationic compounds having a pyridinium group are described, for example, in PSA Journal, Section B 36 (1953), U.S. Pat. Nos. 2,648,604 and 3,671,247, Japanese Patent Publication Nos. 30074/69 and 9503/69, etc.

In the present invention, though it is not necessary to incorporate substances or dyes for preventing irradiation or halation in the photographic materials, because the photographic materials are colored by the dye releasing compound, it is possible to add filter dyes or light absorbent materials, etc., as described in Japanese Patent Publication No. 3692/73 and U.S. Pat. Nos. 3,253,921, 2,527,583 and 2,956,879 in order to further improve sharpness. It is preferred that these dyes have a thermal bleaching property. For example, dyes as described in U.S. Pat. Nos. 3,769,019, 3,745,009 and 3,615,432 are preferred.

The photographic materials according to the present invention may contain, if necessary, various additives known for the heat-developable photographic materials and may have a layer other than the light-sensitive layer, for example, an antistatic layer, an electrically conductive layer, a protective layer, an intermediate layer, an antihalation layer and a strippable layer, etc. Examples of additives include those described in *Research Disclosure,* Vol. 170, No. 17029 (June, 1978), for example, plasticizers, dyes for improving sharpness, antihalation dyes, sensitizing dyes, matting agents, surface active agents, fluorescent whitening agents and fading preventing agents, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 3,681,294 and drying in a manner similar to preparing the heat-developable light-sensitive layer of the present invention, by which the photographic material is obtained.

If necessary, two or more layers may be applied at the same time by the method as described in U.S. Pat. No. 2,761,791 and British Pat. No. 837,095.

Various means of exposure can be used in connection with the heat-developable photographic materials of the present invention. Latent images are obtained by imagewise exposure by radiant rays including visible rays. Generally, light sources used for conventional color prints can be used, examples of which include tungsten lamps, mercury lamps, halogen lamps such as an iodine lamp, a xenon lamp, laser light sources, CRT light sources, fluorescent tubes and light-emitting diodes, etc.

The original may be line drawings or photographs having gradation. Further, it is possible to take a photograph of a portrait or landscape by means of a camera.

Printing from the original may be carried out by contact printing by superposing the original on the photographic material or may be carried out by reflection printing or enlargement printing.

It is also possible to carry out the printing of images photographed by a videocamera or image informations sent from a television broadcasting station by directly displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The photographic material to be sensitized by these lights is produced so as to release a yellow dye, a magenta dye and a cyan dye, respectively.

The photographic material is produced using a construction such that the green-sensitive part (layer) contains a yellow dye releasing compound, the red-sensitive part (layer) contains a magenta dye releasing compound and the infrered-sensitive part (layer) contains a cyan dye releasing compound. Other combinations can be utilized, if necessary.

In addition to the above-described methods of contacting or projecting the original, there is a method of exposure wherein the original illuminated by a light source is stored in a memory of a leading computer by means of a light-receiving element such as a phototube or a charge coupling device (CCD). The resulting information is, if necessary, subjected to processing, the so-called image treatment, and resulting image information is reproduced on CRT which can be utilized as an image-like light source or lights are emitted by three kinds of LED according to the processed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful. As the heating means, a simple heat plate, iron, heat roller or analogues thereof may be used.

In the present invention, a specific method for forming a color image by heat development comprises heat diffusion transfer of a hydrophilic diffusible dye. For this purpose, the heat-developable color photographic material is composed of a support having thereon a light-sensitive layer (I) containing at least a silver halide, an organic silver salt oxidizing agent, a dye releasing compound which is also a reducing agent for the organic silver salt oxidizing agent, a hydrophilic binder and a dye releasing activator, and an image receiving layer (II) capable of receiving the hydrophilic diffusible dye formed in the light-sensitive layer (I).

The above-described light-sensitive layer (I) an image receiving layer (II) may be formed on the same support, or they may be formed on different supports, respectively. The image receiving layer (II) can be stripped off the light-sensitive layer (I). For example, after the heat-developable color photographic material is exposed imagewise to light, it is developed by heating uniformly and thereafter the image receiving layer (II) is peeled apart.

In accordance with another process, after the heat-developable color photographic material is exposed imagewise to light and developed by heating uniformly, the dye can be transferred on the image receiving layer (II) by superposing the image receiving layer on the light-sensitive layer (I) at a temperature lower than the developing temperature. The temperature lower than the developing temperature in such a case include room temperature and preferably a temperature from room temperature to a temperature not less than about 40° C. lower than the heat-developing temperature. For example, a heat-developing temperature and a transferring temperature are 120° C. and 80° C., respectively. Further, there is a method wherein only the light-sensitive layer (I) is exposed imagewise to light and then developed by heating uniformly by superposing the image receiving layer (II) on the light-sensitive layer (I).

The image receiving layer (II) can contain a dye mordant. In the present invention, various mordants can be used, and a useful mordant can be selected according to properties of the dye, conditions for transfer, and other components contained in the photographic material, etc. The mordants which can be used in the present invention include high molecular weight polymer mordants.

Polymer mordants to be used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, those which migrate with difficulty from a mordanting layer to other layers are preferable; for example, mordants capable of cross-linking with a matrix such as gelatin, water-insoluble mordants, and aqueous sol (or latex dispersion) type mordants are preferably used.

Particularly preferable polymer mordants are described in Japanese Patent Application No. 157798/81.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from about 20/80 to 80/20 (by weight) and the amount of the mordant coated is from 0.5 to 8 g/m$^2$.

The image receiving layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which are observed through the transparent support are obtained.

Typical image receiving materials for diffusion transfer are obtained by mixing the polymer containing ammonium salt groups with gelatin and applying the mixture to a transparent support.

The transfer of dyes from the photographic light-sensitive layer to the image receiving layer can be carried out using a transfer solvent. Examples of useful transfer solvents include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The transfer solvent can be employed by wetting the image receiving layer with the transfer solvent or by incorporating it in the form of water of crystallization or microcapsules into the photographic material.

The present invention will be explained in greater detail with reference to the following examples, but the present invention should not be construed as being limited thereto.

EXAMPLE 1

40 g of gelatin and 26 g of potassium bromide were dissolved in 3,000 ml of water and the solution was stirred while maintaining the temperature at 50° C. A solution containing 34 g of silver nitrate dissolved in 200 ml of water was added to the above-described solution over a period of 10 minutes. Then, a solution containing 3.3 g of potassium iodide dissolved in 100 ml of water was added for a period of 2 minutes. By controlling the pH of the silver iodobromide emulsion thus prepared precipitate was formed and the excess salts were removed. The pH of the emulsion was then adjusted to 6.0 and 400 g of the silver iodobromide emulsion was obtained.

In the following, a method of preparing a gelatin dispersion of a dye releasing compound is described.

A mixture of 10 g of the dye releasing compound having the following structure:

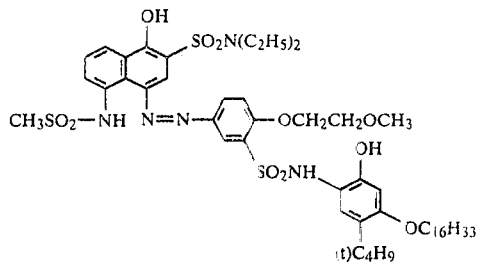

0.5 g of sodium 2-ethylhexylsulfosuccinate, 20 g of tricresyl phosphate (TCP) and 30 ml of ethyl acetate was heated at about 60° C. to form a solution. The solution was mixed with 100 g of a 10% aqueous solution of gelatin and then dispersed using a homogenizer at 10,000 rpm for 10 minutes. The dispersion thus prepared is designated a dispersion of a dye releasing compound.

In the following, a method of preparing a light-sensitive coating is described.

(a) a light-sensitive silver iodobromide emulsion: 5 g
(b) a dispersion of a dye releasing compound: 3.5 g
(c) a solution containing 0.25 g of guanidine trichloroacetate dissolved in 2.5 ml of ethanol
(d) a solution containing 0.09 g of the compound: $(CH_3)_2NSO_2NH_2$ according to the present invention dissolved in 4 ml of water The above-described components (a) to (d) were mixed and dissolved by heating. The solution was coated on a polyethylene terephthalate film having a thickness of 180μ at a wet thickness of 60 μm and dried. The sample thus-prepared was exposed imagewise at 2,000 lux for 10 seconds using a tungsten lamp and then uniformly heated on a heat block for 20 seconds which had been heated at 140° C. This is designated Sample A.

Also, Sample B was prepared in the same manner as described in Sample A except that 4 ml of water was used in place of the component (d) according to the present invention and subjected to the same procedure as described above.

In the following, a method of preparing an imge receiving material having an image receiving layer is described.

10 g of a copolymer of methyl acrylate and N,N,N-trimethyl-N-vinylbenzyl ammonium chloride (a ratio of methyl acrylate and vinyl benzyl ammonium chloride being 1:1) was dissolved in 200 ml of water and the solution was uniformly mixed with 100 g of a 10% aqueous solution of lime-processed gelatin. The mixture was uniformly coated on a polyethylene terephthalate film at a wet thickness of 20 μm and dried to prepare an image receiving material.

The image receiving material was soaked in water and superposed on the heated photographic light-sensitive materials described above (Samples A and B) in order to bring them into contact with each of the surface layers. After heating them on a heat block at 80° C. for 6 seconds, the image receiving material was peeled apart from the photographic light-sensitive material to obtain a negative magenta color image on the image receiving material. The optical density of the negative image was measured using a Macbeth transmission densitometer (TD-504). The following results were obtained.

| Sample No. | Maximum Density | Minimum Density |
|---|---|---|
| A (Present Invention) | 2.15 | 0.20 |
| B (Comparison) | 1.03 | 0.18 |

It is apparent from the results shown above that the compound according to the present invention provides thee extremely high optical density.

EXAMPLE 2

The same procedure and process as described in Example 1 were repeated except using the compound described below. As a result, the following results were obtained.

| Sample No. | Compound | Amount (g) | Maximum Density |
|---|---|---|---|
| C | $H_2NSO_2NH$ | 0.13 | 2.00 |
| D | 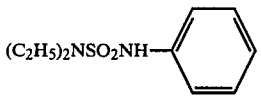 | 0.40 | 1.84 |
| E | $(C_2H_5)_2NSO_2NH_2$ | 0.10 | 2.20 |
| F | $(C_3H_7)_2NSO_2NH_2$ | 0.12 | 2.12 |
| G | $(C_2H_5)_2NSO_2N(C_2H_5)_2$ | 0.14 | 1.88 |
| H | 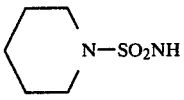 | 0.12 | 2.18 |

-continued

| Sample No. | Compound | Amount (g) | Maximum Density |
|---|---|---|---|
| I | 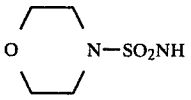 | 0.12 | 2.15 |
| J | 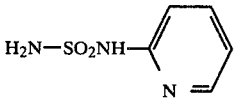 | 0.20 | 1.98 |
| K | 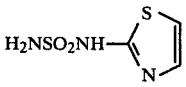 | 0.20 | 1.90 |

It is apparent from the results shown above that the compounds according to the present invention have excellent effects.

EXAMPLE 3

Dispersions of a dye releasing compound were prepared in the same manner as described in Example 1 except using 10 g of the dye releasing compounds having the formulae described below respectively in place of the dye releasing compound used in Example 1.

Compound for Dispersion α

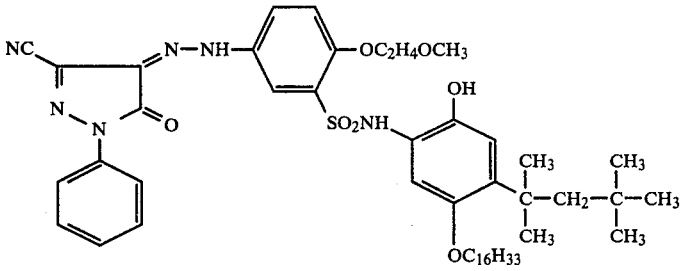

Compound for Dispersion β

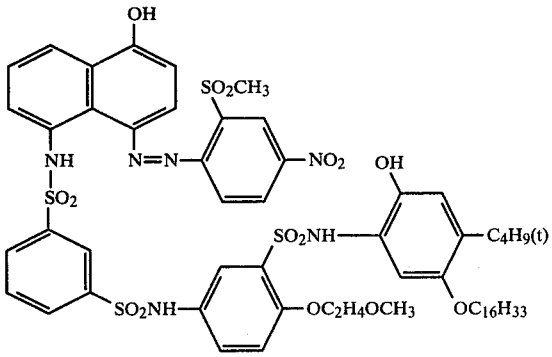

The samples were prepared and subjected to the processing in the same manner as described in Example 1. The results thus-obtained are shown in the following.

| Dispersion of Dye Releasing Compound | Compound of the Present Invention | Maximum Density | Minimum Density |
|---|---|---|---|
| Dispersion α | Present | 1.22 | 0.12 |
| Dispersion α | None | 0.65 | 0.11 |
| Dispersion β | Present | 2.20 | 0.20 |
| Dispersion β | None | 1.15 | 0.20 |

It is apparent from the results shown above that the compound according to the present invention can provide an extremely high maximum density.

EXAMPLE 4

An emulsion was prepared in the following manner in place of the emulsion in Example 1.

6.5 g of benzotriazole and 10 g of gelatin were dissolved in 1,000 ml of water and the solution was stirred while maintaining the temperature at 50° C. A solution containing 8.5 g of silver nitrate dissolved in 100 ml of water was added to the above-described solution over a period of 2 minutes. Then, a solution containing 1.2 g of potassium bromide dissolved in 50 ml of water was added for a period of 2 minutes. By controlling the pH of the emulsion thus-prepared precipitate was formed and the excess salts were removed. The pH of the smulsion was then adjusted to 6.0 and 200 g of the emulsion was obtained.

In the following, a method of preparing a light-sensitive coating is described.

(a) a silver benzotriazole emulsion containing a light-sensitive silver bromide: 10 g
(b) a dispersion of a dye releasing compound (the same as in Example 1): 3.5 g
(c) a solution containing 0.25 g of guanidine trichloroacetate dissolved in 2.5 ml of ethanol
(d) a solution containing 0.14 g of the compound: $(C_2H_5)_2NSO_2NH_2$ according to the present invention dissolved in 4 ml of water The above-described components (a) to (d) were mixed and then the same procedure as described in Example 1 was repeated to prepare samples which were subjected to the same processing as described in Example 1. The results thus obtained are shown below.

| Sample | Compound | Maximum Density | Minimum Density |
|---|---|---|---|
| Present Invention | $(C_2H_5)_2NSO_2NH_2$ | 2.35 | 0.20 |

-continued

| Sample | Compound | Maximum Density | Minimum Density |
|---|---|---|---|
| Comparison | None | 1.10 | 0.18 |

It is apparent from the results shown above that the compound according to the present invention provides an extremely high density.

EXAMPLE 5

The same emulsion as described in Example 4 was prepared. A dispersion of a dye releasing compound was prepared in the same manner as described in Example 1 except using 10 g of the dye releasing compound having the formula described below in place of the dye releasing compound used in Example 1.

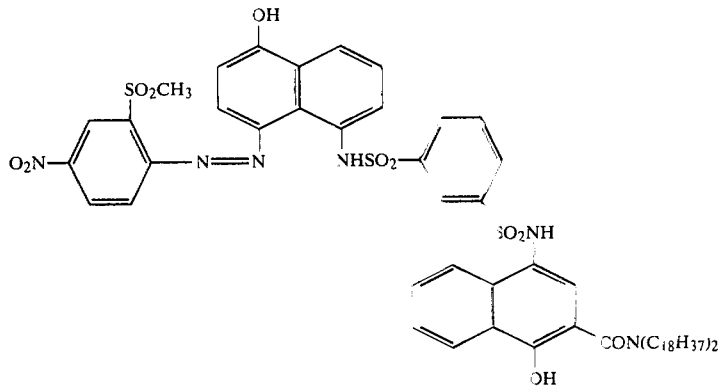

A light-sensitive coating was prepared in the following manner.

(a) a silver benzotriazole emulsion containing a light-sensitive silver bromide: 10 g
(b) a dispersion of a dye releasing compound: 3.5 g
(c) a solution containing 0.28 g of the compound: $(CH_3)_2NSO_2NH_2$ according to the present invention dissolved in 4 ml water
(d) a solution containing 0.2 g of the compound:

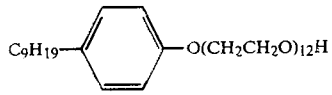

dissolved in 4 ml of water

The above-described components (a) to (d) were mixed and dissolved by heating. The solution was coated on a polyethylene terephthalate film having a thickness of 180μ at a wet thickness of 60 μm and dried. The sample thus-prepared was exposed imagewise at 2,000 lux for 10 seconds using a tungsten lamp and then uniformly heated on a heat block which has been heated at 160° C. for 30 seconds. This is designated Sample A.

Also, Sample B was prepared in the same manner as described in Sample A except that 4 ml of water was used in place of the component (c) according to the present invention and subjected to the same procedure as described above.

The preparation of the image receiving material and the processing followed were carried out in the same manner as described in Example 1. The results thus obtained are shown below.

| Sample No. | Maximum Density | Minimum Density |
|---|---|---|
| A (Present Invention) | 1.40 | 0.24 |
| B (Comparison) | 0.85 | 0.22 |

It is apparent from the results shown above that the compound according to the present invention provide a low fog level and a high density.

While the invention has been described in detail and with reference to specific embodiments thereof, it will be apparent to one skilled in the art that various changes and modifications can be made therein without departing from the spirit and scope thereof.

What is claimed is:

1. A heat-developable color photographic material, comprising:

a support base having thereon:

a light-sensitive silver halide emulsion layer containing a hydrophilic binder, a dye releasing compound reductive and capable of releasing a hydrophilic dye; and a compound represented by the general formula (A):

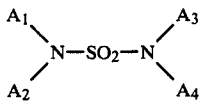

(A)

wherein $A_1$, $A_2$, $A_3$ and $A_4$, independently represent a hydrogen atom or a substituent selected from an alkyl group, a substituted alkyl group, a cycloalkyl group, an aralkyl group, an aryl group, a substituted aryl group and a heterocyclic group or $A_1$ and $A_2$ or $A_3$ and $A_4$ may combine with each other to form a ring.

2. A heat-developable color photographic material as claimed in claim 1, wherein the alkyl group has 1 to 18 carbon atoms, the cycloalkyl group has 3 to 18 carbon atoms, the aralkyl group has 7 to 18 carbon atoms, the aryl group has 6 to 18 carbon atoms, and the heterocyclic group contains at least one hetero atom selected from the group consisting of a nitrogen atom, a sulfur atom and an oxygen atom.

3. A heat-developable color photographic material as claimed in claim 1, wherein the substituent for the substituted alkyl group represented by $A_1$, $A_2$, $A_3$ or $A_4$ is an alkoxy group having 1 to 18 carbon atoms, a hydroxy group, a cyano group or a halogen atom.

4. A heat-developable color photographic material as claimed in claim 1, wherein the substituent for the substituted aryl group represented by $A_1$, $A_2$, $A_3$ or $A_4$ is an alkyl group having 1 to 18 carbon atoms, a cyano group, a nitro group or a halogen atom.

5. A heat-developable color photographic material as claimed in claim 1, wherein the heterocyclic group represented by $A_1$, $A_2$, $A_3$ and $A_4$ is a 5-membered or 6-membered heterocyclic ring containing at least one hetero-atom selected from the group consisting of a nitrogen atom, a sulfur atom and an oxygen atom.

6. A heat-developable color photographic material as claimed in claim 1, wherein at least one of $A_1$, $A_2$, $A_3$ and $A_4$ is a hydrogen atom.

7. A heat-developable color photographic material as claimed in claim 1, wherein the compound represented by the general formula (A) is present in a range from 1/100 time to 10 times by molar ratio based on silver.

8. A heat-developable color photographic material as claimed in claim 1, wherein the dye releasing compound reductive and capable of releasing a hydrophilic dye is represented by the following general formula (I):

$$R—SO_2—D \quad (I)$$

wherein R represents a reducing group capable of being oxidized by the silver halide; and D represents a dye portion for forming an image containing a hydrophilic group.

9. A heat-developable color photographic material as claimed in claim 8, wherein the reducing group represented by R has an oxidation-reduction potential to a saturated calomel electrode of 1.2 V or less.

10. A heat-developable color photographic material as claimed in claim 8, wherein the reducing group represented by R is represented by the following general formulae (II) to (IX):

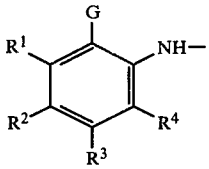

(II)

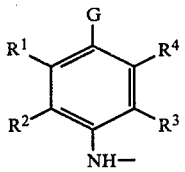

(III)

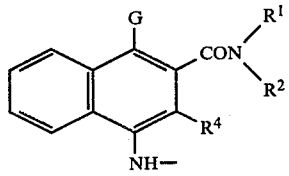

(IV)

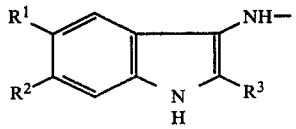

(V)

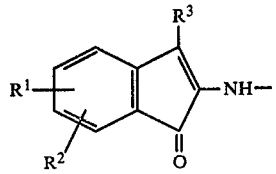

(VI)

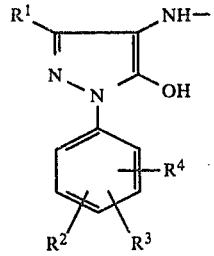

(VII)

-continued

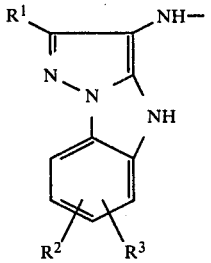

(VIII)

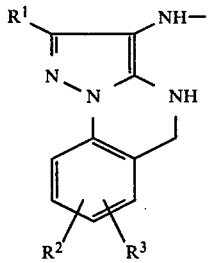

(IX)

wherein G represents a hydroxy group or a group giving a hydroxy group upon hydrolysis, and $R^1$, $R^2$, $R^3$ and $R^4$, which may be the same or different, each represents a hydrogen atom, an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group.

11. A heat-developable color photographic material as claimed in claim 8, wherein the dye portion represented by D includes an azo dye, an azomethine dye, an anthraquinone dye, a naphthoquinone dye, a styryl dye, a nitro dye, a quinoline dye, a carbonyl dye or a phthalocyanine dye.

12. A heat-developable color photographic material as claimed in claim 8, wherein the hydrophilic group included in the dye portion represented by D is a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group or an alkoxyalkoxy group.

13. A heat-developable color photographic material as claimed in claim 1, wherein the color photographic material further contains a reducing agent.

14. A heat-developable color photographic material as claimed in claim 1, wherein the light-sensitive silver halide is silver chloride, silver chlorobromide, silver chloroiodide, silver bromide, silver iodobromide, silver chloroiodobromide or silver iodide.

15. A heat-developable color photographic material as claimed in claim 1, wherein the color photographic material further contains an organic silver salt oxidizing agent.

16. A heat-developable color photographic material as claimed in claim 1, wherein the hydrophilic binder is gelatin or a gelatin derivative.

17. A heat-developable color photographic material as claimed in claim 1, wherein the color photographic material further contains a thermal solvent.

18. A heat-developable color photographic material as claimed in claim 1, wherein the color photographic material further comprises an image receiving layer capable of receiving the hydrophilic dye.

19. A heat-developable color photographic material as claimed in claim 18, wherein the image receiving layer contains a dye mordant.

20. A heat-developable color photographic material as claimed in claim 1, wherein the color photographic material further contains a transfer solvent.

21. A method of forming a color image, comprising the steps of:

imagewise exposing color photographic material;

developing the material by heating the material at a temperature in the range of 80° C. to 250° C. in order to release a hydrophilic diffusible dye; and transferring the diffusible dye into an image receiving material, the color photographic material comprising a heat-developable color photographic material comprising a support base having thereon a light-sensitive silver halide emulsion layer containing a hydrophilic bender, a dye releasing compound reductive and capable of releasing a hydrophilic dye, and a compound represented by the following general formula (A):

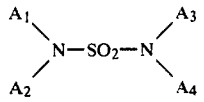

A)

wherein $A_1$, $A_2$, $A_3$and $A_4$, independently represent a hydrogen atom or a substituent selected from an alkyl group, a substituted alkyl group, a cycloalkyl group, an aralkyl group, an aryl group, a substituted aryl group and a heterocyclic group, or $A_1$ and $A_2$, or $A_3$ and $A_4$ may combine with each other to form a ring.

22. A method of forming a color image as claimed in claim 21, wherein the transferring of the hydrophilic diffusible dye is carried out using a transfer solvent.

* * * * *